US011304506B2

(12) United States Patent
Taine et al.

(10) Patent No.: US 11,304,506 B2
(45) Date of Patent: Apr. 19, 2022

(54) BRUSH FOR APPLYING A COSMETIC PRODUCT, RELATED METHOD AND KIT

(71) Applicant: L'OREAL, Paris (FR)

(72) Inventors: Clemence Taine, Clichy (FR); Cecile Eurippini, Clichy (FR)

(73) Assignee: L'OREAL, Paris (FR)

( * ) Notice: Subject to any disclaimer, the term of this patent is extended or adjusted under 35 U.S.C. 154(b) by 428 days.

(21) Appl. No.: 16/323,955

(22) PCT Filed: Aug. 3, 2017

(86) PCT No.: PCT/EP2017/069707
§ 371 (c)(1),
(2) Date: Feb. 7, 2019

(87) PCT Pub. No.: WO2018/029090
PCT Pub. Date: Feb. 15, 2018

(65) Prior Publication Data

US 2019/0166985 A1 Jun. 6, 2019

(30) Foreign Application Priority Data

Aug. 11, 2016 (FR) ..... 16 57726

(51) Int. Cl.
*A46B 9/02* (2006.01)
*A46D 1/00* (2006.01)
*A45D 19/00* (2006.01)

(52) U.S. Cl.
CPC ..... *A46B 9/023* (2013.01); *A45D 19/012* (2021.01); *A46D 1/0253* (2013.01); *A45D 2200/25* (2013.01); *A46B 2200/1046* (2013.01)

(58) Field of Classification Search
CPC .. A46B 9/00; A46B 9/02; A46B 9/021; A46B 9/023; A46B 9/025; A46B 9/026; A46B 9/028; A46B 9/06; A46B 9/065; A46B 9/08; A46B 9/10; A46B 9/12; A46B 2200/00; A46B 2200/01; A46B 2200/10; A46B 2200/1006; A46B 2200/1013; A46B 2200/104; A46B 2200/1046;
(Continued)

(56) References Cited

U.S. PATENT DOCUMENTS 5,195,546 A * 3/1993 Cansler ..... A45D 33/00 132/317
5,881,426 A * 3/1999 Tong ..... A46B 9/023 15/201

(Continued)

FOREIGN PATENT DOCUMENTS

DE 2 739 694 A1 3/1979
DE 82 08 444 U1 6/1982

(Continued)

*Primary Examiner* — Rachel R Steitz
*Assistant Examiner* — Karim Asqiriba
(74) *Attorney, Agent, or Firm* — Polsinelli PC

(57) ABSTRACT

Brush (10) for application of a cosmetic product, particularly a hair coloring and/or care product, comprising: —a handle (12)—a product applicator (14) projecting from the handle (12), the applicator (14) comprising crimped fibers (40). The crimped fibers (40) are between 0.25 mm and 0.45 mm thick and the crimp wave length is between 2.0 mm and 4.0 mm.

20 Claims, 2 Drawing Sheets

(58) Field of Classification Search
CPC ..... A46B 2200/1053; A46B 2200/20; A46B 2200/3086; A46B 2200/40; A46B 2200/106; A45D 19/00; A45D 19/012; A46D 1/00; A46D 1/02; A46D 1/0207; A46D 1/0215; A46D 1/0223; A46D 1/0238; A46D 1/0253; A46D 1/0261; A46D 1/0276; A46D 1/0284; A46D 1/0292
USPC ..... 15/207.2
See application file for complete search history.

(56) References Cited

U.S. PATENT DOCUMENTS 6,079,087 A † 6/2000 Cansler
2005/0115583 A1* 6/2005 Lhoyer ..... A46D 1/00 132/218
2007/0151061 A1* 7/2007 Mink ..... A46B 9/021 15/160
2011/0083690 A1* 4/2011 Cardenas ..... A45D 44/005 132/120
2013/0114989 A1* 5/2013 McNamara ..... A45D 40/265 401/130
2013/0330288 A1* 12/2013 Sato ..... A61Q 1/10 424/63
2014/0166041 A1* 6/2014 King ..... A46D 3/00 132/320
2015/0273517 A1* 10/2015 Beuer ..... A46B 9/02 15/207.2

FOREIGN PATENT DOCUMENTS

EP 0 761 125 A1 3/1997
WO WO 2005/085089 A1 9/2005

* cited by examiner
† cited by third party

BRUSH FOR APPLYING A COSMETIC PRODUCT, RELATED METHOD AND KIT

CROSS REFERENCE TO RELATED APPLICATIONS

This application is a National Phase filing under 35 U.S.C. § 371 of PCT/EP2017/069707 filed on Aug. 3, 2017; and this application claims priority to Application No. 16 57726 filed in France on Aug. 11, 2016. The entire contents of each application are hereby incorporated by reference.

BACKGROUND OF DISCLOSURE

Technical Field

This invention relates to a brush for application of a cosmetic product, particularly a hair coloring and/or hair care product, comprising a handle, a product applicator projecting from the handle, the applicator comprising crimped fibers.

This brush is designed to be manipulated by a user to apply a cosmetic product such as a hair coloring and/or hair care product on keratin fibers and particularly on the hair. The cosmetic product is generally in the form of a cream, a gel or a liquid.

The brush is designed for use by a professional in a salon to apply the product to a third party, or advantageously directly by the user in self-application, for example at home.

Background Art

More generally, a cosmetic product is a product as defined in EC Regulation No 1223/2009 of the European Parliament and the Council of Nov. 30, 2009, relating to cosmetic products.

Known application brushes comprise a handle and an applicator fixed to the handle that comprises separate tufts of straight fibers.

Before application, the user dips the applicator into a reservoir of a coloring product, and then brings the applicator to the hair to be colored so as to spread the product on the hair.

However, straight fibers tend to facilitate the accumulation of clumps of the product on the applicator while the product is being collected, and particularly between tufts. In particular, this leads to bad distribution of the product on the user's hair during application. In particular, this also leads to loss and wastage of formula that remains trapped between tufts of the brush after application.

U.S. Pat. No. 5,195,546, EP1846597 and WO9810681 describe powder make up application brushes with crimped bristles.

EP893958 and EP923327 describe toothbrushes with crimped bristles.

BRIEF SUMMARY OF DISCLOSURE

One purpose of the invention is to obtain a brush for application of a cosmetic product that enables efficient collection of a fluid product on the applicator, particularly a hair coloring or hair care product that is conducive to a uniform deposit on keratin fibers and the scalp.

The purpose of the invention to achieve this is a brush for application of a cosmetic product of the type mentioned above, characterized in that the crimped fibers are between 0.25 mm and 0.45 mm thick and the crimp wave length is between 2.0 mm and 4.0 mm.

The crimped fibers thus have optimum characteristics for improving collection of the cosmetic product on the applicator and to efficiently distribute it in the applicator of the brush. Thus with the brush according to the invention, the quantity of formula collected can be 20% to 25% higher than with a brush with straight fibers for a coloring formula with a viscosity measured at 25° C. between 200 mPa·s and 3000 mPa·s, and preferably between 800 mPa·s and 1200 mPa·s, and particularly approximately 1000 mPa·s, these units being measured at a shear rate of 50 $s^{-1}$.

The cosmetic product is placed uniformly between fibers and between tufts of fibers, avoiding the development of clumps of product on the applicator. The cosmetic product is delivered to keratin fibers and/or to the scalp with minimum losses. The deposit on keratin fibers and/or the scalp is then much more uniform than with straight fibers.

The brush according to the invention can include one or more of the following features, taken alone or in any technically possible combination:

Advantageously, the crimp wave length of the crimped fibers is between 3.0 mm and 3.5 mm;

Such a wave length is particularly conducive to the distribution of product on the crimped fibers.

Advantageously, the thickness of the crimped fibers is between 0.30 mm and 0.38 mm;

This thickness advantageously assures good elasticity of the crimped fibers and sufficient stiffness to facilitate displacement of the applicator on the user's hair and the resulting product application.

Advantageously, the transverse amplitude of each wave of the crimped fibers is between 0.5 mm and 0.7 mm.

This characteristic assures that the crimped fibers remain flexible during application of the brush on the hair.

Advantageously, the crimped fibers form discontiguous tufts distributed transversely across the handle.

In particular, the distribution of crimped fibers in the form of tufts facilitates mounting of the applicator on the brush handle using standard bristling methods and machines on the market.

Advantageously, the ratio between the maximum thickness of each tuft and the maximum space between two adjacent tufts is between 1 and 2.

This ratio reduces liquid traps that can be formed between tufts of the applicator.

Advantageously, the maximum space between two adjacent tufts is between 1.5 mm and 2.5 mm This characteristic makes it possible to collect a sufficient quantity of product on the applicator.

Advantageously, the applicator has a beveled upper edge.

This cut makes application more ergonomic for the user, particularly during application on the temples. The pressure in the user's arms is lowered, which is more comfortable in the long term. Furthermore, this bevel cut comprises two different angles so that the precision of application can be modulated as a function of the application zone.

Advantageously, each crimped fiber present is longer than 1 cm, preferably longer than 1.3 cm, and even more preferably longer than 1.8 cm.

This fiber length is particularly suitable for use of the brush with a fiber coloring and/or care product.

Advantageously, the handle comprises a head defining two opposite dished gripping zones.

The opposite dished gripping zones optimize the grip obtained by a user's finger pads.

Another purpose of the invention is a method for applying a cosmetic product, including the following steps:

- impregnation of a brush as defined above with a cosmetic product, particularly a hair coloring and/or a hair care product;
- application of the brush applicator on the keratin fibers and/or on the scalp Another purpose of the invention is an application kit comprising a brush as defined above and a cosmetic product.

The kit according to the invention can include one or more of the following features, taken alone or in any technically possible combination:

- the cosmetic product is a coloring and/or a care product for hair, keratin fibers and the scalp;
- the viscosity of the cosmetic product is between 200 mPa·s and 3000 mPa·s, preferably between 800 mPa·s and 1200 mPa·s, and more particularly approximately equal to 1000 mPa·s, measured at 25° C., with a shear rate of 50 $s^{-1}$.

A cosmetic product with such a viscosity cooperates particularly advantageously with a brush as defined above to increase the amount of product collected, to avoid the formation of clumps of products, and to obtain a very uniform application.

BRIEF DESCRIPTION OF THE SEVERAL VIEWS OF THE DRAWINGS

The invention will be easier to understand after reading the following description, provided solely as an example and with reference to the appended drawings, wherein.

DETAILED DESCRIPTION OF THE DISCLOSURE

Figure 1:
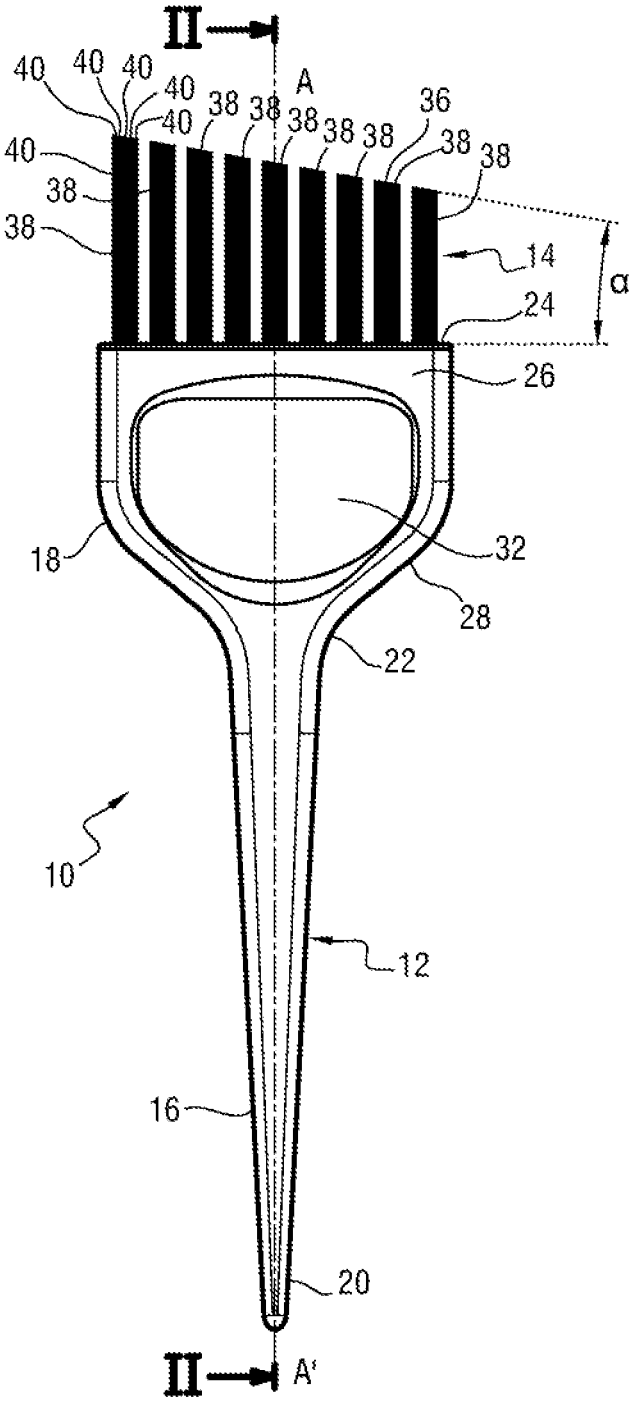
FIG. 1 is an elevation view of a brush according to the invention.

A brush 10 for application of a cosmetic product is illustrated on FIG. 1.

The brush 10 is used particularly for application of a cosmetic product such as a coloring product and/or a care product, on a user's keratin fibers.

The keratin fibers of a user are advantageously the user's hair.

The viscosity of the cosmetic product at 25° C. is advantageously between 200 mPa·s and 3000 mPa·s, preferably between 800 mPa·s and 1200 mPa·s, and more particularly approximately equal to 1000 mPa·s. These units are measured at a shear rate of 50 $s^{-1}$.

The viscosity of the products is measured at 25° C. using a Brookfield LVT viscometer equipped with a mobile M4 rotating at a speed of 12 revolutions per minute. The measurement is taken after 1 minute.

The cosmetic composition is for example made using a mix of a first cosmetic coloring product and a second cosmetic oxidizing product.

The first cosmetic product comprises an alkaline agent in a known manner. The alkaline agent is for example inorganic such as ammonia, or organic such as an organic amine, or hybrid such as an amine salt. It advantageously comprises at least one coloring agent such as an oxidation dye precursor, a direct coloring agent or mixtures thereof. It may contain at least one anionic, nonionic, cationic, amphoteric and/or zwitterionic surfactant.

The second cosmetic product contains at least one oxidizing agent, different from the oxygen in the air, such as hydrogen peroxide. It comprises at least one fat. The term "fat" refers to an organic compound insoluble in water at ordinary temperatures (25° C.) and at atmospheric pressure (760 mm of Hg) (solubility less than 5% and preferably 1% and even more preferably 0.1%). The fats are chosen for example from hydrocarbons, oils, fatty alcohols, esters of fatty acid and/or of fatty alcohols different from triglycerides and plant waxes, non-silicone waxes, silicones, and mixtures thereof.

Figure 2:
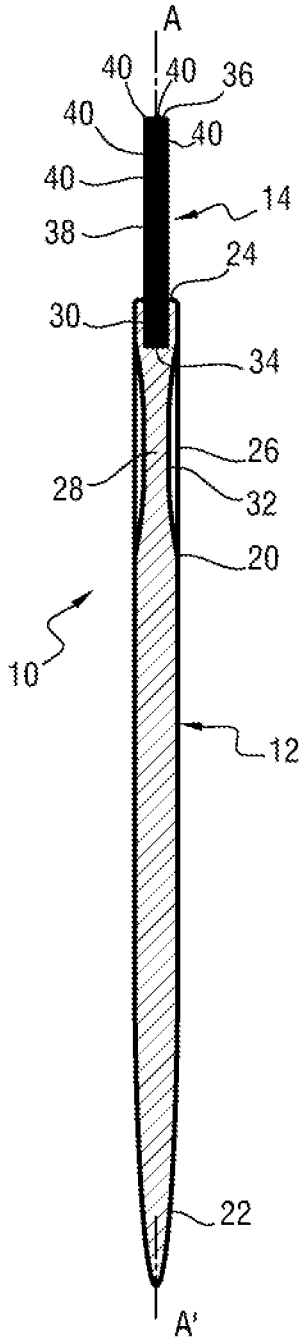
FIG. 2 is a sectional view along plane II-II in FIG. 1.
Figure 3:
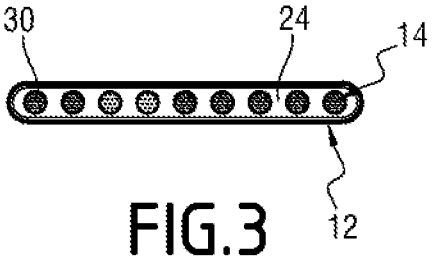
FIG. 3 is a top view of the brush in FIG. 1.

With reference to FIGS. 1 to 3, the brush 10 comprises a handle 12 extending along a longitudinal axis A-A' and an applicator 14 that projects longitudinally from the handle 12.

The thickness of the handle 12 is less than 10 mm and in particular is between 4 mm and 6 mm. This limits the dimensions of the brush 10.

The handle 12 comprises a stem 16 and a head 18 extending from the end of the stem 16, the applicator 14 projecting from the head 18.

Advantageously, the cross-section of the stem 16 of the handle 12 becomes smaller with increasing distance from the head 18. In particular, the general shape of the stem 16 is in the form of a "V".

The stem 16 extends between a free proximal end 20 and a distal end 22 from which the head 18 projects.

The proximal end 20 of the stem 16 is narrower than the distal end 22. The step 16 is thus tapered at its proximal end 20.

In this way, the user can use the proximal end 20 of the stem 16 to precisely select a particular lock of hair during application or to separate the lock of hair.

In the illustrated example, the head 18 of the handle 12 has a polygonal general shape, with an approximately rectangular distal region and a proximal region converging towards the stem 16.

The head 18 of the handle 12 comprises an upper face 24, two opposite principal faces 26, and two side faces 28 opening up on the principal faces 28. The lateral faces 28 converge towards the stem 16 of the handle 12.

As can be seen on FIG. 2, the upper face 24 of the head 18 of the handle 12 extends perpendicular to the longitudinal axis A-A'.

The upper face 24 defines several holes 30 that contain tufts of the applicator 14. Each hole 30 projects along a longitudinal direction of the handle 12.

Each hole 30 may for example have a depth of between 5 mm and 7 mm, for example a depth equal to 6 mm.

In the example shown, the upper face 24 of the head 18 comprises at least one row of identical holes 30 distributed over the entire width of the head 18. The number of holes is more than 5 and for example is between 8 and 12.

Each principal face 26 of the head 18 of the sleeve 12 delimits a dish shaped gripping zone 32. The surface area of each gripping zone 32 is at least 60% of the total surface area of the principal face 26.

Preferably, each gripping zone 32 has a depth of more than 0.5 mm, particularly between 0.8 mm and 1.2 mm.

In this example, the stem 16 and the head 18 of the handle 12 are made in a single-piece from the same material. For example, the handle 12 can be made of plastic, particularly polypropylene or polyethylene.

The applicator 14 projects from the handle 12 and extends in the same plane as the handle 12. It comprises a proximal end 34 fixed in the handle 12. It defines a free distal edge 36 located at a distance from the handle 12.

Advantageously, the free distal edge 36 of the applicator 14 is beveled. For example, the angle α formed by the beveled cutout is between 1° and 20°, particularly between 5° and 15°, and more particularly between 8° and 12°, for example close to 100, from the upper face 24 of the head 18 of the handle 12.

The ratio of the length between the longest fibers and the shortest fibers must be small, for example between 1.05 and 1.5, to obtain a uniform application quality of the formula on the hair and/or on the scalp.

The applicator 14 comprises several tufts 38 each composed of a group of crimped fibers 40. The tufts 38 are transversely distributed on the upper face 24 of the head 18 of the handle 12.

The maximum thickness of each tuft 38 taken perpendicular to the A-A' axis is less than 5 mm, and is advantageously between 2.5 mm and 3.5 mm.

There is a maximum space between consecutive tufts 38 taken perpendicular to the A-A' axis, equal to between 1.5 mm and 2.5 mm.

The space between two consecutive tufts 38 is equal to the maximum distance separating two corresponding crimped fibers 40 of two consecutive tufts 38, located facing each other and closest to each other.

Advantageously, the space between two consecutive tufts 38 is between 1.8 mm and 2.2 mm. As a result, the tufts 38 define a space between tufts adapted to hold an optimum quantity of cosmetic product.

The ratio between the diameter of each tuft 38 and the space between two consecutive tufts 38 is between 1 and 2, and particularly between 1.4 and 1.6. The appearance of liquid traps on the applicator 14 is thus limited.

The proximal end of each tuft 38 defining the proximal edge of the applicator 14 is housed in a corresponding hole 30 in the upper face 24 of the head 18 of the handle 12. Thus there is one tuft 38 in each hole 30.

Each tuft 38 comprises several crimped fibers 40, arranged at random in the tuft 38.

Advantageously, each tuft 38 comprises a number of crimped fibers 40 equal to between 30 and 50 fibers, and preferably between 38 and 42 fibers.

Figure 4:
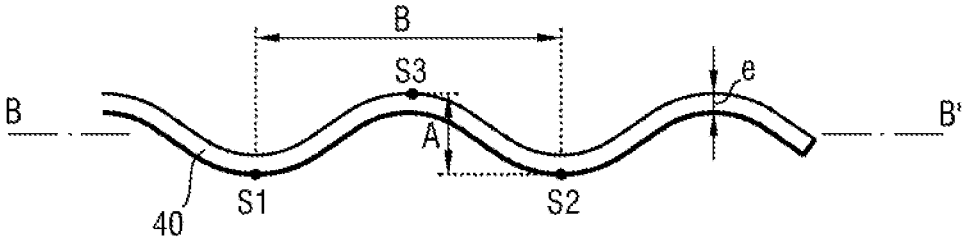
FIG. 4 is a side view of part of a fiber of the brush in FIG. 1.

An example of a crimped fiber 40 is shown in FIG. 4.

Each crimped fiber 40 has a thickness e equal to between 0.25 mm and 0.45 mm. Thus, the fibers 40 are springy and yet sufficiently stiff to facilitate application on the hair.

Preferably, the thickness e of each crimped fiber 40 is between 0.30 mm and 0.38 mm, for example approximately equal to 0.35 mm.

Preferably, the thickness of each crimped fiber 40 is constant over the entire length of the crimped fiber 40 such that the cut finish of the crimped fibers 40 at the top edge 36 is rough. As a result, the product is retained on the top edge 36 of the applicator 14. This prevents the cosmetic product from running along the brush 10.

The length of each crimped fiber 40 is more than 15 mm, and particularly between 20 mm and 28 mm.

The crimp wave length B of each crimped fiber 40 is between 2 mm and 4 mm. As a result, the product is efficiently distributed on the applicator 14.

Advantageously, the crimp wave length B of each crimped fiber 40 is between 3.0 mm and 3.5 mm, for example equal to 3.2 mm;

The crimp wave length B is defined with reference to FIG. 4 as the distance separating two successive peaks S1, S2 of the crimp located on the same side of the longitudinal median axis B-B' of the crimped fiber 40.

Each crimped fiber 40 has a crimp amplitude A equal to between 0.5 mm and 0.7 mm. Thus, the flexibility of the crimped fibers 40 is adapted to application on hair.

For example, the crimp amplitude A of each crimped fiber 40 is equal to 0.6 mm.

"Crimp amplitude" means the "peak to peak" amplitude corresponding to the distance measured between two successive summits S2, S3 of the crimp, perpendicular to the B-B' axis.

The crimped fibers 40 are preferably made from plastic, for example polyamide, and particularly PA6 nylon.

A method for applying cosmetic product using the brush 10 will now be described.

In a first step, the user prepares a cosmetic product to be applied to keratin fibers, for example coloring product and/or a hair care product.

He or she then dips the crimped fibers 40 of the applicator 14 of the brush 10 into the cosmetic product and impregnates the applicator 14 of the brush 10 with cosmetic product.

The cosmetic product penetrates between the crimped fibers 40 of the applicator 14. It is naturally and uniformly distributed between the crimped fibers 40.

The user then places the applicator 14 impregnated with cosmetic product on the hair and/or the scalp.

The user uses the distal end 22 of the stem 16 of the handle 12 to separate the lock of hair or the hair parting, so as to apply the cosmetic product along the length of a lock of hair of for application on the root of the hair.

The user makes a direct application on the temples or on the root by holding the handle 12 by the head 18 and squeezing opposite gripping zones 32 with his or her fingers.

Figure 5:
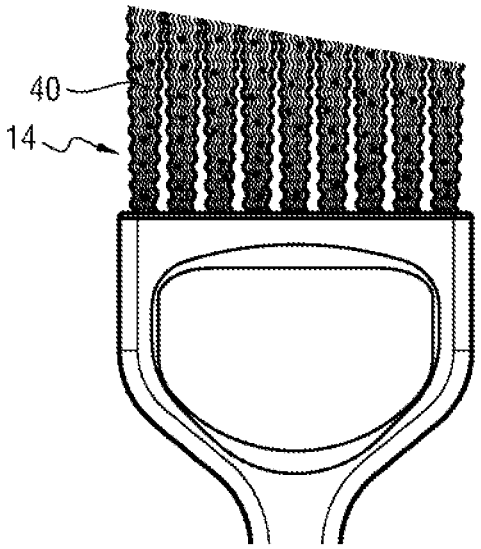
FIG. 5 is a detailed view of the applicator of the brush in FIG. 1, after collecting cosmetic product.
Figure 6:
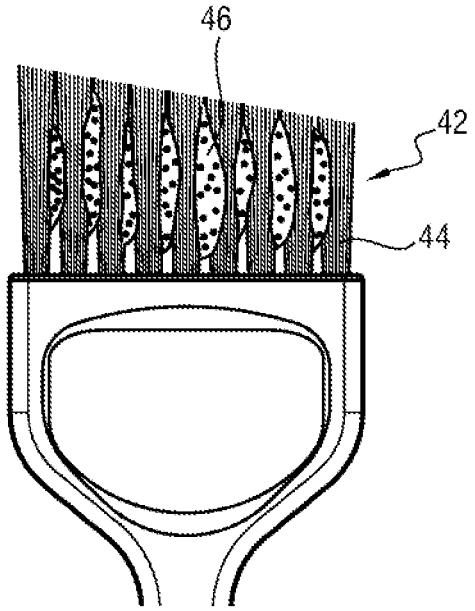
FIG. 6 is a view equivalent to that in FIG. 5 of an applicator according to the state of the art.

FIGS. 5 and 6 show a comparative illustration of the distribution of cosmetic product on the applicator 14 as described above and on an applicator 42 according to another embodiment.

The applicator 14 illustrated on FIG. 5 comprises crimped fibers 40 as described above. The cosmetic product is then distributed uniformly between the crimped fibers 40.

The applicator 42 on the brush according to the state of the art illustrated in FIG. 6, comprises straight fibers 44. The cosmetic product is not retained optimally by the straight fibers 44 and product clumps 46 form between the tufts 38 of straight fibers 44.

For equal thickness, crimped fibers 40 are more diffuse than straight fibers 44 and pick up more cosmetic product on the applicator 14 than straight fibers 44, with 20% to 25% more collected in the example presented in the figures.

As a variant, the handle 12 can have a different shape and/or the number of tufts 38 and the number of crimped fibers 40 per tuft 38 can be different, without changing the function and performances of the brush 10.

The brush described above has beneficial properties for the user, particularly when the user applies the product himself or herself at home.

In particular, the brush facilitates collection of the cosmetic product on the applicator while preventing running. Furthermore, the brush distributes the product uniformly on the applicator to obtain an optimum deposit of the product on the user's hair. The brush is both flexible and robust to make it more comfortable and to achieve efficient application on hair. Furthermore, the brush according to the invention is ergonomic and precise and is more comfortable for the user throughout the application duration.

In one variant, the brush is packaged in the form of an application kit comprising the brush 10 as described above, at least one cosmetic product received in a receptacle and packaging containing the brush 10 and the receptacle or each receptacle containing the cosmetic product.

Advantageously, the kit comprises a pair of gloves to protect the user's hands during application of the cosmetic formulation, and/or a comb to prepare the hair and/or a bowl to prepare the cosmetic product to be applied to the user's hair.

Due to its small thickness and its large flat surface, it is easy to put the brush in a kit and many brushes can be carried by stacking them.

As a variant, the crimped fibers are mounted in the form of strips with a rectangular cross-section instead of tufts with a circular cross-section.

As another variant, the crimped fibers can be mounted with a twist, the bristles being glued.

The invention claimed is:

1. A brush for application of a cosmetic product, which is a hair coloring and/or hair care product, comprising:

a handle a product applicator projecting from the handle, the applicator comprising crimped fibers, which are in the form of tufts, wherein the crimp wave length is between 2.0 mm and 4.0 mm, and wherein the thickness of the crimped fibers is between 0.30 mm and 0.38 mm, wherein the maximum space between consecutive tufts is between 1.5 mm and 2.5 mm and the ratio between the diameter of each tuft and the space between two consecutive tufts is between 1 and 2.

2. The brush according to claim 1, wherein the crimp wave length (B) of the crimped fibers is between 3.0 mm and 3.5 mm.

3. The brush according to claim 1, wherein each crimped fiber present is longer than 1.3 cm.

4. The brush according to claim 1, wherein the transverse amplitude (A) of the waves of the crimped fibers is between 0.5 mm and 0.7 mm.

5. The brush according to claim 1, wherein the crimped fibers form discontiguous tufts distributed transversely on the handle.

6. The brush according to claim 5, wherein the ratio between the maximum thickness of each tuft and the maximum space between two adjacent tufts is between 1 and 2.

7. The brush according to claim 6, wherein the maximum space between two adjacent tufts is between 1.5 and 2.5 mm.

8. The brush according to claim 1, wherein the applicator has a beveled upper edge.

9. The brush according to claim 1, wherein each crimped fiber present is longer than 1 cm.

10. The brush according to claim 1, wherein the handle comprises a head defining two opposite dished gripping zones.

11. A method of applying a cosmetic product including the following steps:

impregnation of a brush according to claim 1 with a cosmetic product;

application of the applicator of the brush on the keratin fibers and/or on the scalp.

12. An application kit comprising a brush according to claim 1 and a cosmetic product.

13. The kit according to claim 12 wherein the cosmetic product is a coloring and/or a care product for hair, keratin fibers and the scalp.

14. The kit according to claim 12, wherein the viscosity of the cosmetic product is between 200 mPa·s and 3000 mPa·s measured at 25° C., with a shear rate of 50 s-1.

15. The brush according to claim 2, wherein each crimped fiber present is longer than 1.3 cm.

16. The brush according to claim 2, wherein the transverse amplitude (A) of the waves of the crimped fibers is between 0.5 mm and 0.7 mm.

17. The brush according to claim 3, wherein the transverse amplitude (A) of the waves of the crimped fibers is between 0.5 mm and 0.7 mm.

18. The brush according to claim 2, wherein the crimped fibers form discontiguous tufts distributed transversely on the handle.

19. The brush according to claim 3, wherein the crimped fibers form discontiguous tufts distributed transversely on the handle.

20. The brush according to claim 4, wherein the crimped fibers form discontiguous tufts distributed transversely on the handle.

* * * * *